US005896593A

United States Patent [19]

Mizrahi

[11] Patent Number: 5,896,593

[45] Date of Patent: Apr. 27, 1999

[54] PISTON FLUSH VALVE

[76] Inventor: Israel Mizrahi, 6614 Noble Ave., Van Nuys, Calif. 91405

[21] Appl. No.: 08/949,359

[22] Filed: Oct. 14, 1997

[51] Int. Cl.[6] ..... E03D 1/34

[52] U.S. Cl. ..... 4/378; 4/379; 4/324

[58] Field of Search ..... 4/378, 379, 381, 4/382, 383, 384, 388, 324

[56] References Cited

U.S. PATENT DOCUMENTS

| | | | |
|---|---|---|---|
| 4,305,163 | 12/1981 | Raz | 4/379 |
| 5,329,647 | 7/1994 | Condon | 4/378 |
| 5,349,981 | 9/1994 | Schmucki et al. | 4/378 |

*Primary Examiner*—David J. Walczak

*Attorney, Agent, or Firm*—Albert O. Cota

[57] ABSTRACT

A piston flush valve (10) that is installed in a toilet tank (150) and that operates in combination with a ballcock supply valve (152), a trip lever(154) and a refill tube (158). The piston flush valve (10) includes an upper section (12) which is movably attached to a lower section (72) that is attached to a water egress port (160) located on the bottom of the toilet tank(150). The upper section (12) includes an overflow tube (14) which has a vertical series of outwardly extending slots (24). The slots (24) function in combination with a flush-volume spring clip (58) that is attached to a float (44). The spring clip (58) has a notch (60) sized to fit into one of the slots (24). Depending on which slot (24) the notch (60) is inserted will determine the amount of flush water the toilet tank (150) delivers to the toilet bowl (162).

9 Claims, 2 Drawing Sheets

PISTON FLUSH VALVE

TECHNICAL FIELD

The invention pertains to the general field of toilet flushing apparatuses and more particularly to a toilet flushing apparatus that consists of an adjustable-piston flush valve.

BACKGROUND ART

Most conventional toilets consist of three major elements: a toilet tank, which functions as a water reservoir; a toilet bowl that receives and retains a volume of water into which is introduced human water; and a flushing apparatus.

After waste products have been introduced into the toilet bowl they are flushed down the toilet tank by utilizing the flushing apparatus. Once the flushing apparatus is engaged, the water that is in the toilet tank flows into the bowl, while the contaminated water is forced into an external sewage line. The waste is then routed into a sewage system or a septic tank. The water that flows into the bowl from the tank is then ready to accept and dispose of subsequent human waste.

One of the most common flushing apparatuses in use today utilizes a ballcock supply valve that controls the inlet of water into the toilet tank. A buoyant float ball is connected to the ballcock by means of a trip lever and as the toilet tank is filled with water, the buoyant ball rises. The upward motion of the buoyant ball is transmitted to the ballcock supply valve through the trip lever until, at a predetermined water level, the ballcock shuts off the water inlet to the toilet tank. In most toilets, the water level in the tank may be adjusted by means of a screw-set mechanism located in the ballcock supply valve. Once the water level in the tank is set, further adjustment is not required and a consistent volume of water will be discharged each time the toilet is flushed.

It is a well known fact that the largest single use of water in most households, and in many office buildings, is for flushing toilets. This is a result of the flushing being carried out using the full capacity of the water in the tank, which in many cases is not required and therefore wasteful. Substantial interest has been placed in finding a method of reducing the water usage when toilets are flushed, especially when there is a water deficiency, such as during periods of drought.

There are currently several methods in use to conserve water when a toilet is flushed. One such method is to place a bag filled with water or a solid object, such as a brick or stone, into the tank. This causes an equivalent amount of water to be displaced, thus reducing the volume of water that is used for each flush. Another method is to lower the float valve to allow the ballcock to close at a reduced water level. These and other methods used to conserve water are in many cases self-defeating. This is because the effectiveness of a partial flush, which is essentially what is created with these methods, is diminished—it is often necessary to flush twice in order to adequately remove the waste products in the bowl. Additionally, such methods represent a compromise in that once the volume of water is set, it is not readily adjustable.

In summary, the inventive piston flush valve is less complicated than current flush valve apparatuses which produces a higher reliability with less maintenance. Additionally, the piston flush valve can be easily adjusted to provide an optimum volume of water as determined by the location of the toilet and available water pressure.

A search of the prior art did not disclose any patents that read directly on the combination of elements utilized with the instant invention and on the appended claims. However, the instant invention, is considered an improvement on the applicant's prior patent application Ser. No. 08/782,825 which was filed on Jan. 13, 1997.

Disclosure of the Invention

Water is a basic human need and in some areas of the world it is in short supply especially during drought seasons. Further, water may be expensive and often considerable amounts are wasted for sanitation purposes, which includes the disposal of human waste. The conventional method employed to dispose of human waste is the modern toilet, which includes a toilet tank that is coupled to a toilet bowl. Water is released from the toilet tank and is flushed into the toilet bowl to clear the bowl. A water supply valve is then used to refill the water tank for subsequent flushing.

The water supply valve disclosed herein consists of a piston flush valve which is comprised of two major elements: an upper section and a lower section. The upper section includes an overflow tube to which is movably attached a float. The float is easily positioned to allow the volume of flush water in the toilet tank to be selected. The float can be positioned to allow from 1.6 gallons (6.1 liters) to 3.0 gallons (11.4 liters) to flush the toilet bowl. The amount of flush water selected depends on the amount of water pressure available at the toilet site and on the type of toilet being used.

The upper section is attached to the lower section which includes a flush valve attachment structure that is slidably attached to the upper section. From the lower section extends downward a threaded section that is dimensioned to be inserted into a water egress port located on the bottom of the toilet tank. The threaded section is attached to the toilet tank by a locknut.

The piston flush valve includes a trip-lever retaining bracket which accepts a trip lever having various lengths and angle inclinations. Additionally, the invention also features a refill tube securing structure that is inserted into the upper end of the overflow tube. When inserted, the structure secures the refill tube that is inserted into a side opening on the overflow tube.

In view of the above disclosure, it is the primary object of the invention to provide a piston flush valve that is easily attached to toilet tanks and that allows the water volume to be easily adjusted to an optimum level.

In addition to the primary object of the invention it is also an object to provide a piston flush valve that:

- can be used to replace existing models of flushing apparatuses,
- is applicable for use on new toilet tanks,
- is reliable and easily maintained,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
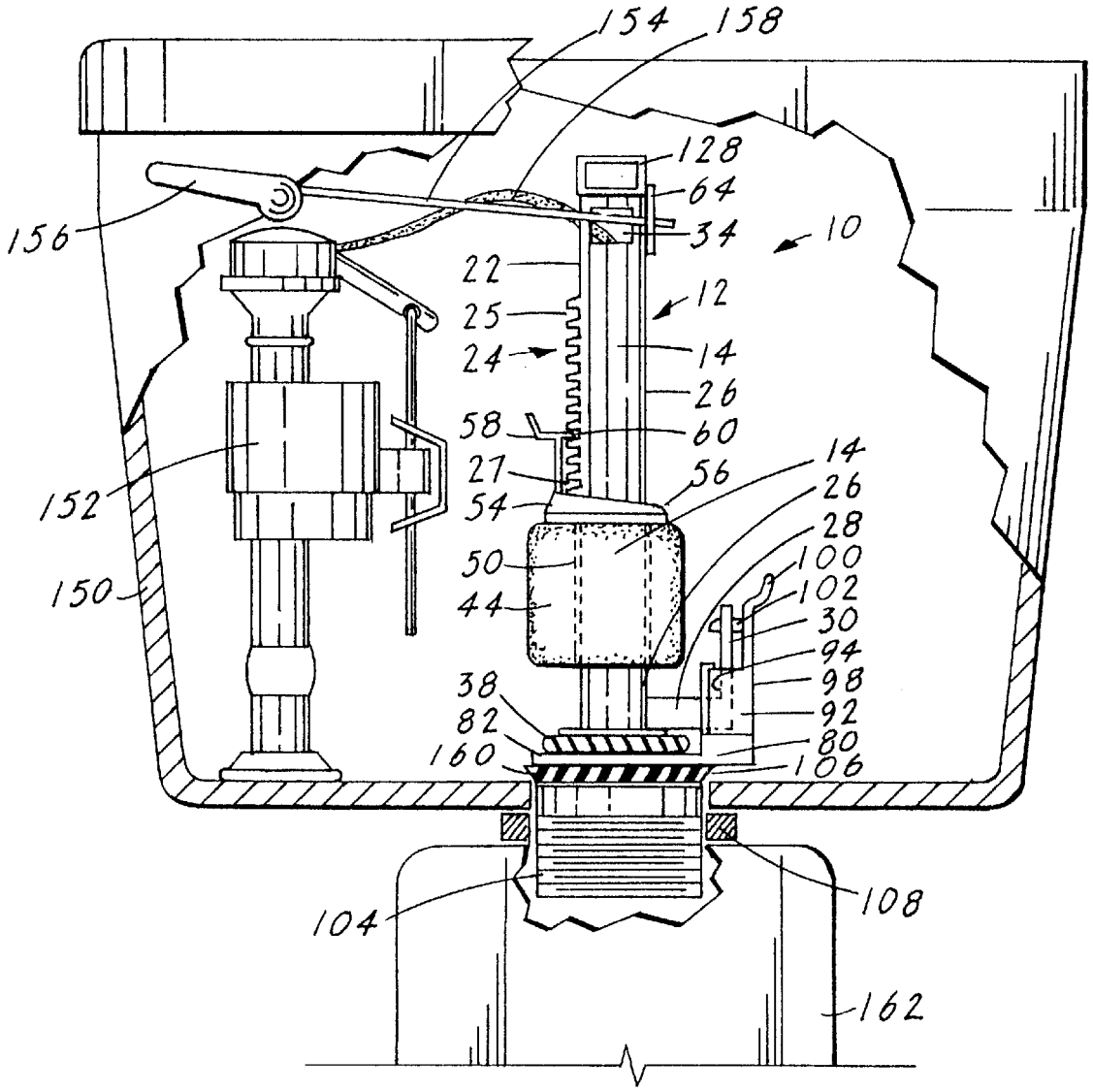
FIG. 1 is a front elevational view of a toilet tank and a toilet bowl with the toilet tank partially cut away to illustrate the position of the piston flush valve.
Figure 3:
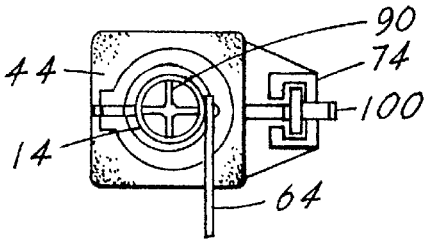
FIG. 3 is a top plan view of the piston flush valve.
Figure 2:
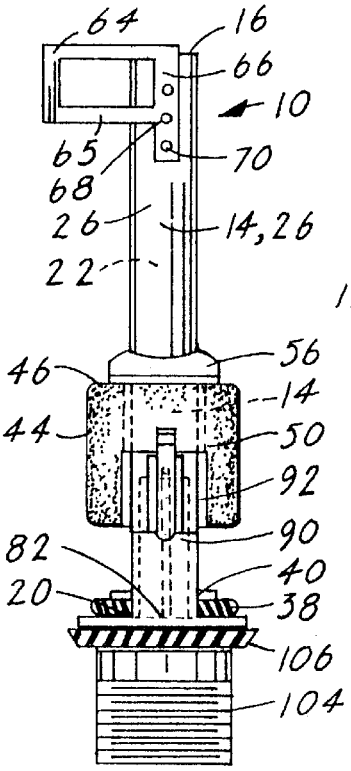
FIG. 2 is a side elevational view of the piston flush valve.
Figure 4:
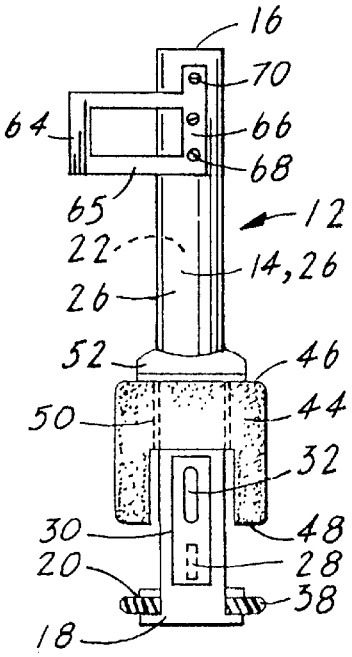
FIG. 4 is a side elevational view of the upper section of the piston flush valve showing the trip-lever retaining bracket rotated 180-degrees from the position shown in FIG. 3.
Figure 5:
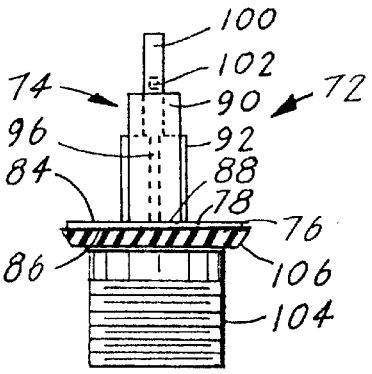
FIG. 5 is a side elevational view of the lower section of the piston flush valve.

The best mode for carrying out the invention is presented in terms of a preferred embodiment for a piston flush valve which is quickly and easily adjusted to deliver an optimum volume of toilet flush water. The piston flush valve 10, as shown in FIGS. 1–7, is comprised of two major elements: an upper section 12 and a lower section 72. The upper section, as best shown in FIGS. 1, 3 and 4, is further comprised of: an overflow tube 14, a valve washer 38, a float 44 and a trip-lever retaining bracket 64; the lower section 72, as shown in FIGS. 1, 2 and 5, is further comprised of a flush-valve attachment structure 74, a threaded section 104, a resilient beveled washer 106 and a locknut 108. The piston flush valve 10 is designed to operate in combination with a toilet tank 150 and a toilet bowl 162 as shown in FIG. 1. The toilet tank incorporated a ballcock supply valve 152, a trip layer 154 that is activated by a flush handle 156 and a refill tube 158.

The piston flush valve 10 is designed to be easily and quickly installed in a toilet tank 150. The installation is accomplished by use of the resilient beveled washer 106 and the locknut 108 as shown in FIG. 1.

Figure 7:
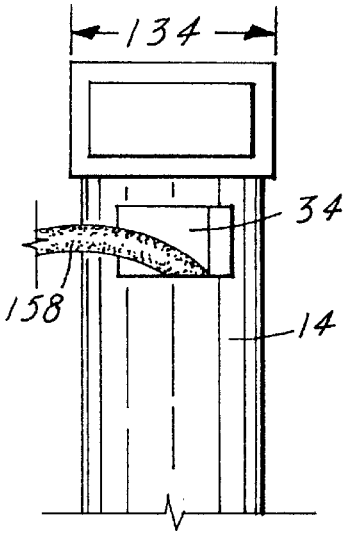
FIG. 7 is a partial elevational view showing the refill tube securing structure inserted into the overflow tube and the refill tube inserted into the side opening in the overflow tube.

The upper section 12, as shown in FIGS. 1–4, is comprised of the overflow tube 14, the valve washer 38, the float 44 and the trip-lever retaining bracket 64. The overflow tube 14 is further comprised of an upper end 16, a lower end 18 having a slotted valve-washer retainer 20, a first side 22 having a vertical series of outward extending slots 24, as shown in FIG. 1 and a second side 26 from where, near the lower end 18, extends outward a horizontal protrusion 28. The horizontal protrusion 28 has attached thereto a vertical section 30 having a vertical slot 32. Near the upper end 16 of the overflow tube 14 is located a side opening 34 as best shown in FIG. 7.

The valve washer 38, as shown in FIG. 2, is made of a resilient material such as rubber, and includes a central opening 40. The opening is dimensioned to be inserted into and held within the slot of the slotted valve-washer retainer 20.

The float 44, which is preferably constructed of polyurethane, consists of an upper surface 46, a lower surface 48 and a vertical bore 50 that extends substantially through the center of the float 44. Around the vertical bore 50, on the upper surface 46 of the float 44, is attached a collar 52 having a first side 54 and a second side 56. The collar 52 and the vertical bore 50 are dimensioned to slidably fit into the overflow tube 14. As shown in FIG. 1, from the first side 54 of the collar 52 extends a flush-volume spring clip 58. The clip has a notch 60 that is dimensioned to be selectively inserted, as shown in FIG. 1, into one of the vertical series of outward extending slots 24 on the overflow tube 14 to allow the float 44 to be placed in a selectable vertical position. The vertical position controls the level of the water in the toilet tank 150 and thus determines the volume of water that is to flow from the toilet tank 150 into the toilet bowl 162. For example, when the notch 60 on the flush-volume spring clip 58 is inserted into the uppermost slot 25, the toilet tank 150 is filled with a minimum volume of flush water, which is typically 1.6 gallons (6.1 liters). Conversely, when the notch 60 on the spring clip 58 is inserted into the lowermost slot 27, the toilet tank is filled with a maximum volume of flush water, which is typically 3.0 gallons (11.4 liters).

The trip-lever retaining bracket 64, as shown in FIGS. 1, 2 and 3, is attached, by an attachment means, to the second side 26 and near the upper end 16 of the overflow tube 14. The trip-lever retaining bracket 64 preferably consists of an enclosed rectangle 65 that includes an inward vertical section 66 that has a plurality of vertical mounting bores 68. These bores 68 allow the bracket 64 to be vertically placed in a first position and attached to the second side 26 of the overflow tube 14 as best shown in FIG. 2. As shown in FIG. 4, the trip-lever retaining bracket 64 may be rotated 180-degrees as referenced from the first position to permit a trip lever 154, having a lower attachment angle, to engage the bracket 64 as shown in FIG. 1. Additionally, the bracket may also be attached to the first side 22 of the overflow tube to permit a trip lever having a shorter length to engage the bracket 64. The preferred means for attaching the trip-lever retaining bracket 64 to the overflow tube 14 consist of inserting at least two screws 70 into the vertical mounting bores 68 and into the vertical tube 14 as shown in FIGS. 2 and 4.

Figure 6:
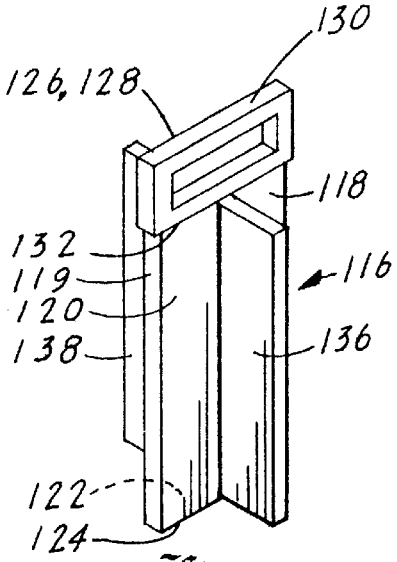
FIG. 6 is a perspective view of the refill tube securing structure.

The overflow tube 14 is also designed to accept a refill tube securing structure 116 that is inserted into its upper end 16. The structure 116, as shown in FIG. 6, consists of a first tab 118 and a second tab 119 each having a first surface 120, a second surface 122, a lower end 124 and an upper section 126. The upper section 126, which functions as a securing structure grip 128, includes an upper edge 130, a lower edge 132 and a lateral length 134 that is greater than the outside diameter of the overflow tube 14. Thus, when the refill tube securing structure 116 is inserted into the upper end 16 of the overflow tube 14 the upper section 126 extends above the upper end 16 of the overflow tube and is held in place as shown in FIG. 7.

Centered and located normal to the first surface 120 of the first and second tabs 118 and 119 is a third tab 136. The third tab 136 has a longitudinal length that commences at the lower edge 132 of the upper section 126 and terminates at the lower end 124 of the first and second tabs 118, 119. The fourth 138 is centered and located normal to the second surface 122 of the first and second tabs 118, 119 has a longitudinal length similar to the length of the third tab 136. When the refill tube securing structure 116 is inserted into the upper end 16 of the overflow tube 14, the securing structure 116 secures the refill tube 158 that is inserted into the side opening 34 of the overflow tube 14 as also shown in FIG. 7.

The refill tube securing structure 116 may also be designed with tabs that taper inward with the upper end of the tabs having a width that prevents the structure 116 from sliding into the overflow tube 14.

The lower section 72, which is shown attached to the upper section 12 in FIGS. 1, 2 and separated in 5, is comprised of a flush-valve attachment structure 74 which is coupled to the upper section 12 and provides the means for attaching the piston flush valve 10 to the toilet tank 150 as shown in FIG. 1. The structure 74 includes a central section 76 having an opening 78 therethrough, a first side 80, a second side 82, an upper surface 84 and a lower surface 86. Across the opening 78 is located a horizontal support 88 from where extends upward a vertical guide 90. The guide 90, which functions as a center guide, is dimensioned to slidably fit into the lower end 18 of the overflow tube 14.

Integrally attached to the first side 80 of the structure 74 is an upper section restraining structure 92 which includes an inward side 94 and an outward side 98. The inward side 94 has a vertical slot 96 dimensioned to slide over and be retained by the horizontal protrusion 28 located on the second side 26 of the overflow tube 14. The outward side 98 of the structure 92 includes a spring clip 100 having a protuberance 102 that is dimensioned to fit into the vertical slot 32 of the vertical section 30 located on the overflow tube 14. When the spring clip 100 is pulled back, the protuberance 102 clears the vertical slot 32 allowing the upper section 12 to be released from the upper section to allow the valve washer to be replaced. The protuberance 102 restrains the vertical movement of the overflow tube 14.

From the lower surface 86 of the flush-valve attachment structure 74 extends downward a threaded section 104 that is dimensioned to be slidably inserted into a water egress port 160 located on the toilet tank 150. Over the threaded section 104 and against the lower surface 86 of the central section 76, is inserted a resilient beveled washed 106. A locknut 108 is then threaded into the threaded section 104 after the lower section 72 is inserted into the water egress port 160 on the toilet tank 150.

Operation

To flush the toilet tank 150, the flush handle 156 is depressed downward causing the rigidly attached trip lever 154 to engage the upper surface of the trip lever retaining bracket 64. This engagement causes the upper section 12 to move upward, which in turn, breaks the seal provided by the valve washer 38. Once the seal is broken, the water in the water tank 150 flows through the opening 78 in the flush-valve attachment structure 74 and into the sewer or septic tank system. After the water has been flushed, gravity causes the upper section 12 to move downward allowing the valve washer 138 to seal the opening 78 allowing water to flow back into the water tank 150 via the ballcock supply valve 152.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

I claim:

1. A piston flush valve designed to operate in combination with a ballcock supply valve, a trip lever and a refill tube, wherein both said valves are located within a toilet tank which is attached to and operates in combination with a toilet bowl, wherein said piston flush valve comprises:

A. an upper section comprising:

a) an overflow tube comprising an upper end, a lower end having a slotted valve-washer retainer, a first side having a vertical series of outward extending slots, a second side from where, near the lower end, extends outward a horizontal protrusion which has attached thereto a vertical section having a vertical slot, and a side opening located near the upper end, b) a valve washer having a central opening dimensioned to be inserted into and held within the slot of the slotted valve-washer retainer, c) a float having an upper surface, a lower surface and a vertical bore therethrough, wherein around the vertical bore, on the upper surface of said float, is attached a collar having a first side and a second side, wherein the collar and the vertical bore are dimensioned to slidably fit into said overflow tube, wherein from the first side of said collar extends a flush-volume spring clip having a notch that is dimensioned to be selectively inserted into one of the slots on said overflow tube to allow said float to be placed in a selectable vertical position which determines the volume of water that is to flow from the toilet tank into the toilet bowl, and d) a trip-lever retaining bracket attached in a first position, by an attachment means, to the second side and near the upper end of said overflow tube, B. A lower section comprising:

a) a flush-valve attachment structure which includes a central section having an opening therethrough, a first side, a second side, an upper surface and a lower surface, where across the opening is located a horizontal support from where extends upward a vertical guide that is dimensioned to slidably fit into the lower end of said overflow tube, wherein integrally attached to the first side of said flush-valve attachment structure is an upper section restraining structure which includes an inward side having a vertical slot dimensioned to slide over and be retained by the horizontal protrusion located on the second side of said overflow tube and an outward side having a spring clip with a protuberance dimensioned to fit into the vertical slot of the vertical section located on said overflow tube wherein when the spring clip is pulled back, the protuberance clears the vertical slot allowing the upper section to be released from said lower section, wherein from the lower surface of said lower section extends downward a threaded section dimensioned to be slidably inserted into a water egress port located on said toilet tank, b) a resilient beveled washer inserted over the threaded section and against the lower surface of said central section, and c) a locknut threaded into the threaded section after said lower section is inserted into the water egress port on said toilet tank.

2. The piston flush valve as specified in claim 1 further comprising a refill-tube securing structure comprising:

a) a first tab and an aligned second tab each having a first surface, a second surface, a lower end and an upper section, wherein the upper section functions as a securing structure grip and includes an upper edge, a lower edge and a lateral length that is greater than the outside diameter of said overflow tube, b) a third tab that is centered and located normal to the first surface of said first and second tabs, wherein said third tab has a longitudinal length that commences at the lower edge of the upper section and terminates at the lower end of said first and second tabs, and c) a fourth tab that is centered and located normal to the second surface of said first and second tabs, wherein said fourth tab has a longitudinal length similar to the length of said third tab, wherein when said refill tube securing structure is inserted into the upper end of said overflow tube, the upper section extends above the upper end of said overflow tube and said securing structure secures the refill tube that is inserted into the side opening of said overflow tube.

3. The piston flush valve as specified in claim 1 wherein said series of outward extending slots include an uppermost slot and a lowermost slot, wherein when the notch on said flush-volume spring clip is inserted into the uppermost slot, the toilet tank is filled with a minimum volume of flush water and conversely when the notch on said spring clip is inserted into the lowermost slot the toilet tank is filled with a maximum volume of water.

4. The piston flush valve as specified in claim 3 wherein the minimum volume of flush water is typically 1.6 gallons (6.1 liters) and the maximum volume of flush water is typically 3.0 gallons (11.4 liters).

5. The piston flush valve as specified in claim 1 wherein said float is constructed of polyurethane.

6. The piston flush valve as specified in claim 1 wherein said trip-lever retaining bracket consists of an enclosed rectangle that includes an inward vertical section having a plurality of vertical mounting bores, wherein the bores allow said bracket to be vertically positioned and attached to the first side or the second side said overflow tube.

7. The piston flush valve as specified in claim 6 wherein said means for attaching said trip-lever retaining bracket to said overflow tube comprises at least two screws inserted into the vertical mounting bores and into said overflow tube.

8. The piston flush valve as specified in claim 7 wherein said trip-lever retaining bracket is attached to the second side and near the upper end of said overflow tube to permit a shorter trip lever to engage said bracket.

9. The piston flush valve as specified in claim 1 wherein said trip-lever retaining bracket is rotated 180-degrees from the first position to permit a trip-lever having a lower attachment angle to engage said bracket.

* * * * *